US012509288B2

(12) United States Patent
Kapinos et al.

(10) Patent No.: US 12,509,288 B2
(45) Date of Patent: Dec. 30, 2025

(54) PACKAGING MATERIALS HAVING SEGMENTS AND CONNECTORS FOR RELEASABLY DETACHING PORTIONS OF NEIGHBORING CONNECTORS

(71) Applicant: Lenovo Enterprise Solutions (Singapore) Pte. Ltd, New Tech Park (SG)

(72) Inventors: Robert J. Kapinos, Morrisville, NC (US); Scott Wentao Li, Morrisville, NC (US); Russell S. VanBlon, Morrisville, NC (US); Robert James Norton, Jr., Morrisville, NC (US)

(73) Assignee: Lenovo Global Technology (United States) Inc., Morrisville, NC (US)

( * ) Notice: Subject to any disclaimer, the term of this patent is extended or adjusted under 35 U.S.C. 154(b) by 113 days.

(21) Appl. No.: 18/604,470

(22) Filed: Mar. 13, 2024

(65) Prior Publication Data

US 2025/0289641 A1 Sep. 18, 2025

(51) Int. Cl.
*B65D 81/05* (2006.01)

(52) U.S. Cl.
CPC ..... *B65D 81/057* (2013.01); *B65D 2581/053* (2013.01); *B65D 2585/6837* (2013.01)

(58) Field of Classification Search
CPC .. B65D 81/053; B65D 81/054; B65D 81/055; B65D 81/057; B65D 2581/053; B65D 2585/6837
USPC ..... 206/320, 453, 586, 591, 592, 594
See application file for complete search history.

(56) References Cited

U.S. PATENT DOCUMENTS 3,684,636 A * 8/1972 Rothrock, Jr. et al. ..... B65D 81/057 428/80
3,843,038 A * 10/1974 Sax ..... B65D 81/056 206/586
3,994,433 A * 11/1976 Jenkins ..... B65D 81/056 206/523
4,238,031 A * 12/1980 Skaggs ..... B65D 59/00 206/521
5,392,920 A * 2/1995 Prete ..... B65D 85/307 206/320
5,871,194 A * 2/1999 Morley ..... B65D 59/00 24/546
6,082,543 A * 7/2000 Beliveau ..... B65D 81/022 206/523
2024/0083655 A1* 3/2024 Bhargava ..... B65D 81/107

* cited by examiner

*Primary Examiner* — Luan K Bui
(74) *Attorney, Agent, or Firm* — Olive Law Group, PLLC

(57) ABSTRACT

Packaging materials having segments and connectors for releasably detaching portions of neighboring connectors are disclosed. According to an aspect, packaging material includes segments positioned end-to-end with respect to each other. The packaging material also includes connectors that each include a first portion and a second portion for attaching respective neighboring segments together. Each first portion can pivotally connect its respective neighboring segments together. Each second portion is configured to separate for releasing its attachment of the neighboring segments. Further, the packaging material includes protrusions that are each attached to a respective segment. The protrusions are configured to at least partially abut each other when neighboring segments are pivoted with respect to each other to a corner packaging position.

20 Claims, 8 Drawing Sheets

PACKAGING MATERIALS HAVING SEGMENTS AND CONNECTORS FOR RELEASABLY DETACHING PORTIONS OF NEIGHBORING CONNECTORS

TECHNICAL FIELD

The presently disclosed subject matter relates generally to packaging materials. Particularly, the presently disclosed subject matter relates to packaging materials having segments and connectors for releasably detaching portions of neighboring connectors.

BACKGROUND

Electronic devices, other equipment, and various items are often packaged for storage and transport. Paperboard, such as cardboard, is a material commonly used for packaging. Typically, it is made from multiple layers of paper or pulp pressed and glued together to a desired strength and thickness. Often paperboard is cut, shaped, and folded in order to form box for packaging an item. The paperboard can then be taped or otherwise held together with the item placed inside.

Aside from the box in which to place an item, often additional packaging material is needed to protect the item. For example, packaging "peanuts" made of foam can be added to the box to provide cushioning for an item. The packaging peanuts are placed into the empty spaces of the box to surround and cushion an item for transport or storage. Although effective for packaging, there are environmental concerns due to their non-biodegradable characteristic.

An alternative to packaging peanuts is the use of paperboard for filling empty spaces in packaging boxes. In these instances, the paperboard is often cut, shaped, and folded for fitting to specific gaps between a packaged item and the interior surfaces of the box. The fitted paperboard can then provide cushioning and rigid support to fragile items, such as electronic devices.

There is a generally need for packaging material that is more convenient for use in packaging items in boxes for storage or transport. There is also a need for paperboard packaging materials that can be easily shaped and sized for packaging items of various sizes and shapes. Such improvements can increase efficiencies and reduce costs associated with packaging and transporting items.

BRIEF DESCRIPTION OF THE DRAWINGS

Figure 1:
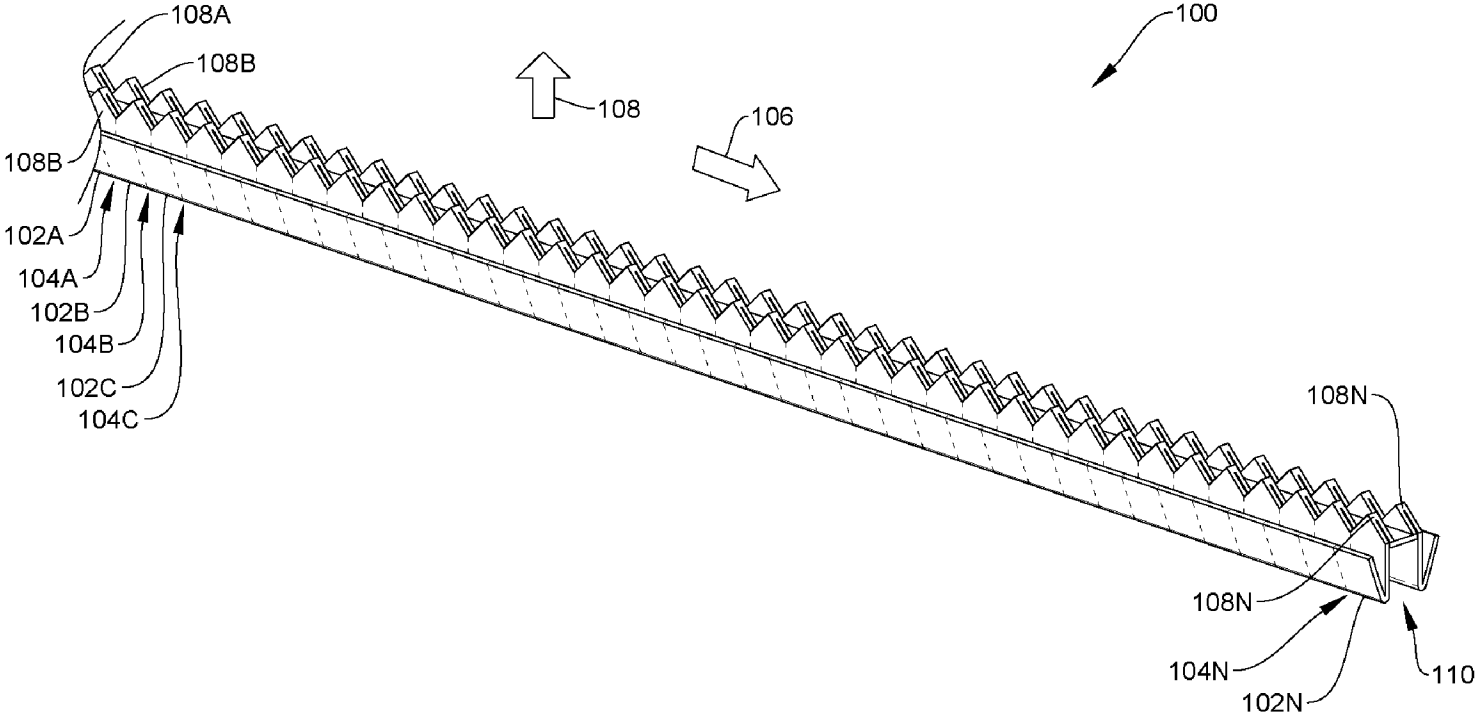
Figure 2:
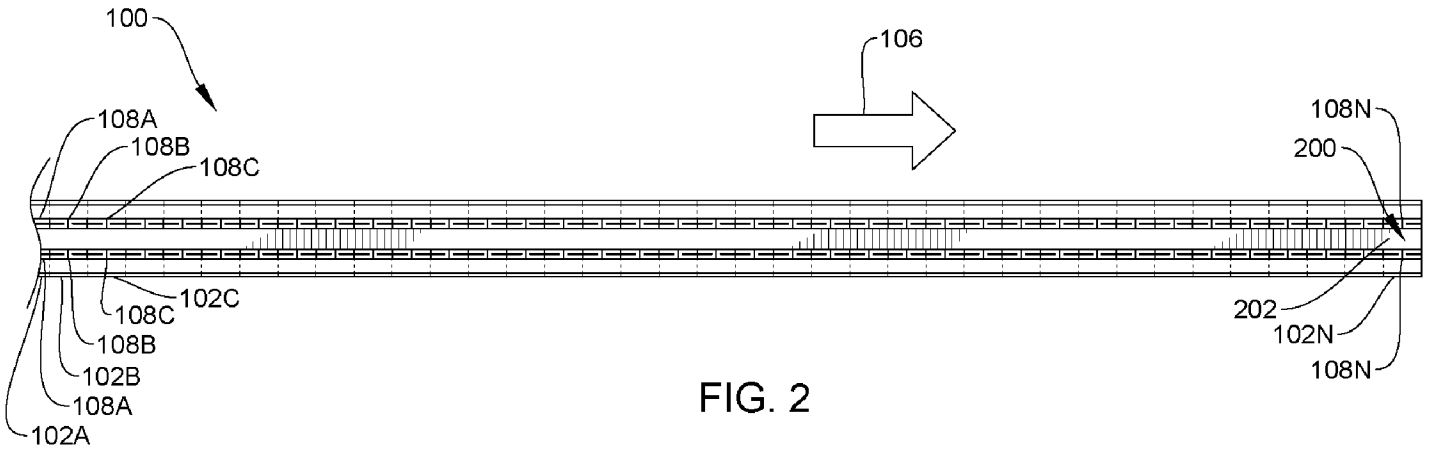
Figure 3:
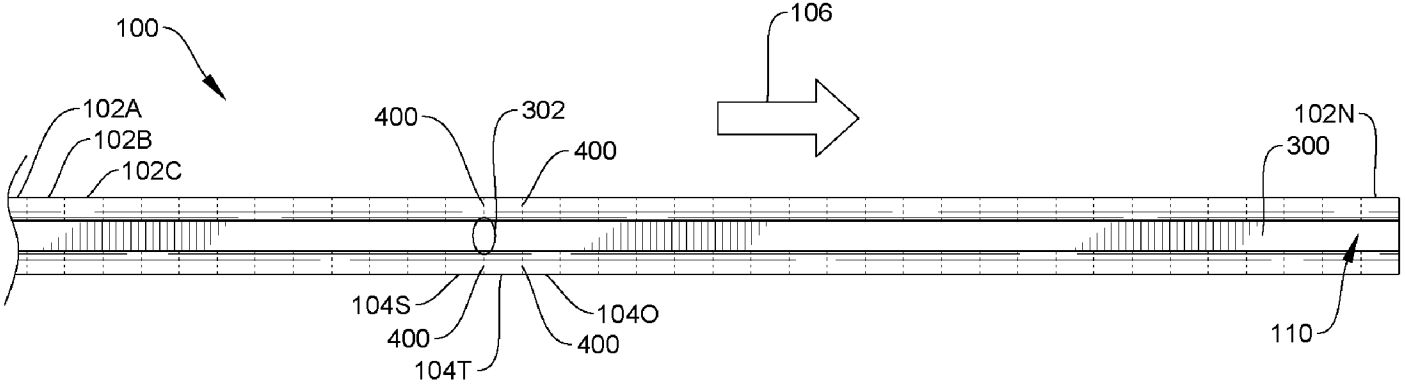
Figure 4:
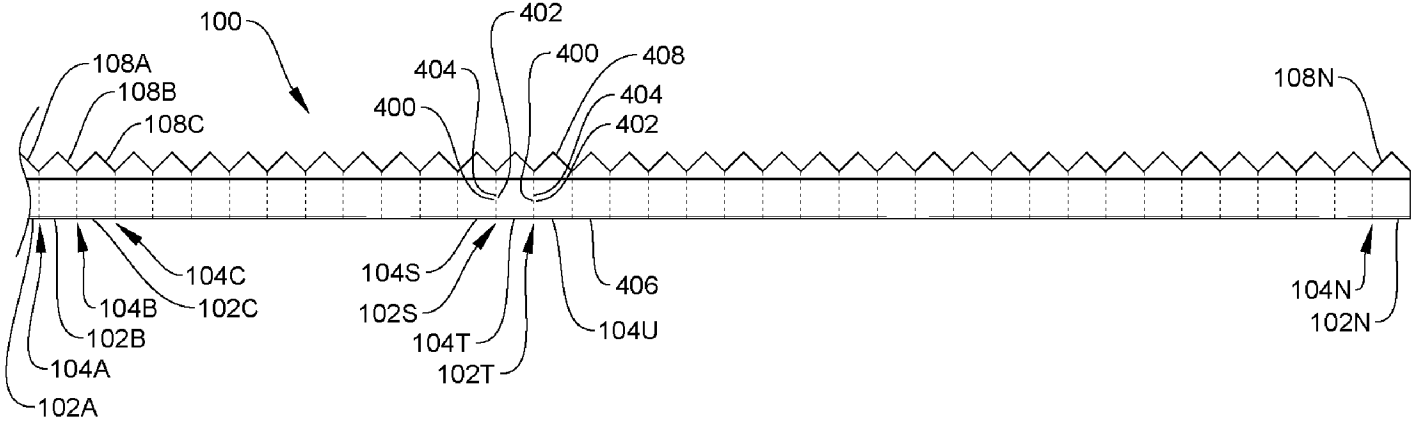
Figure 5:
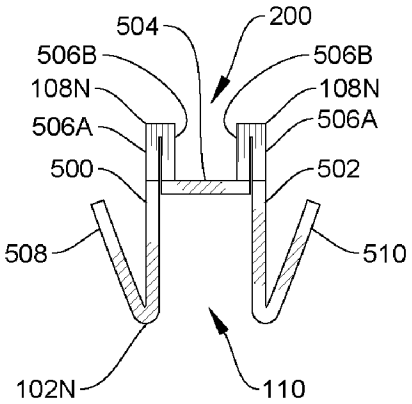
Figure 6:
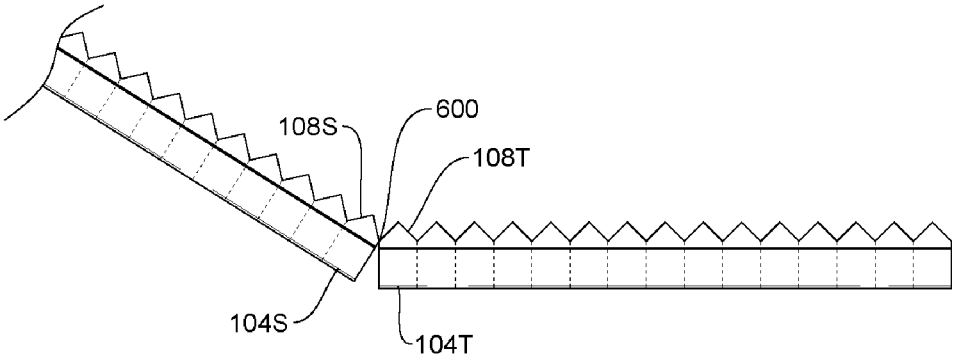
Figure 7:
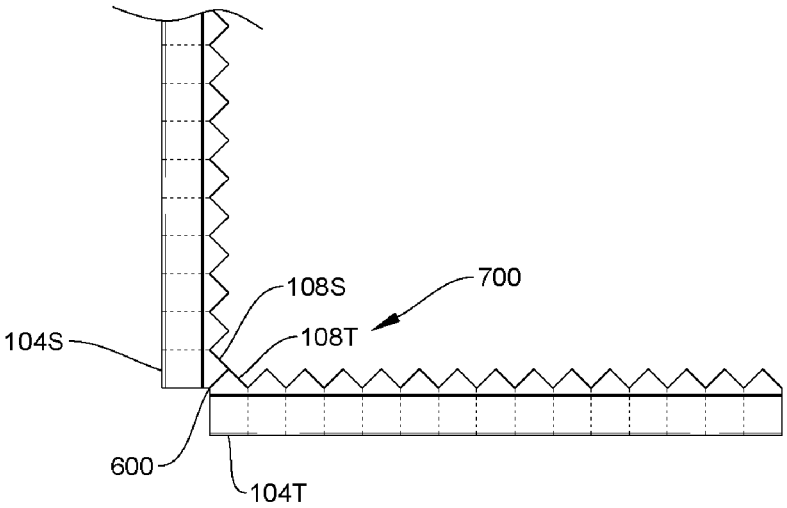
Figure 8:
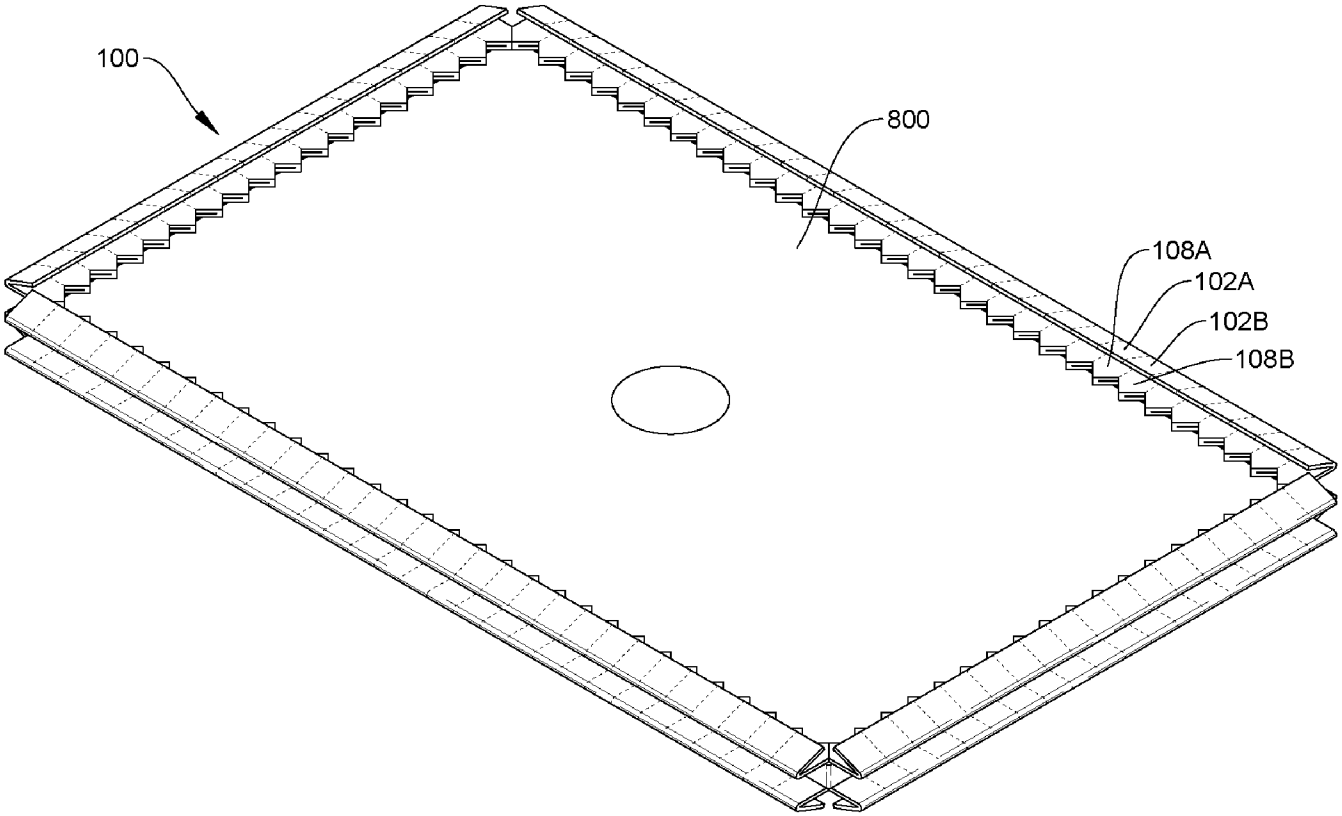
Figure 9:
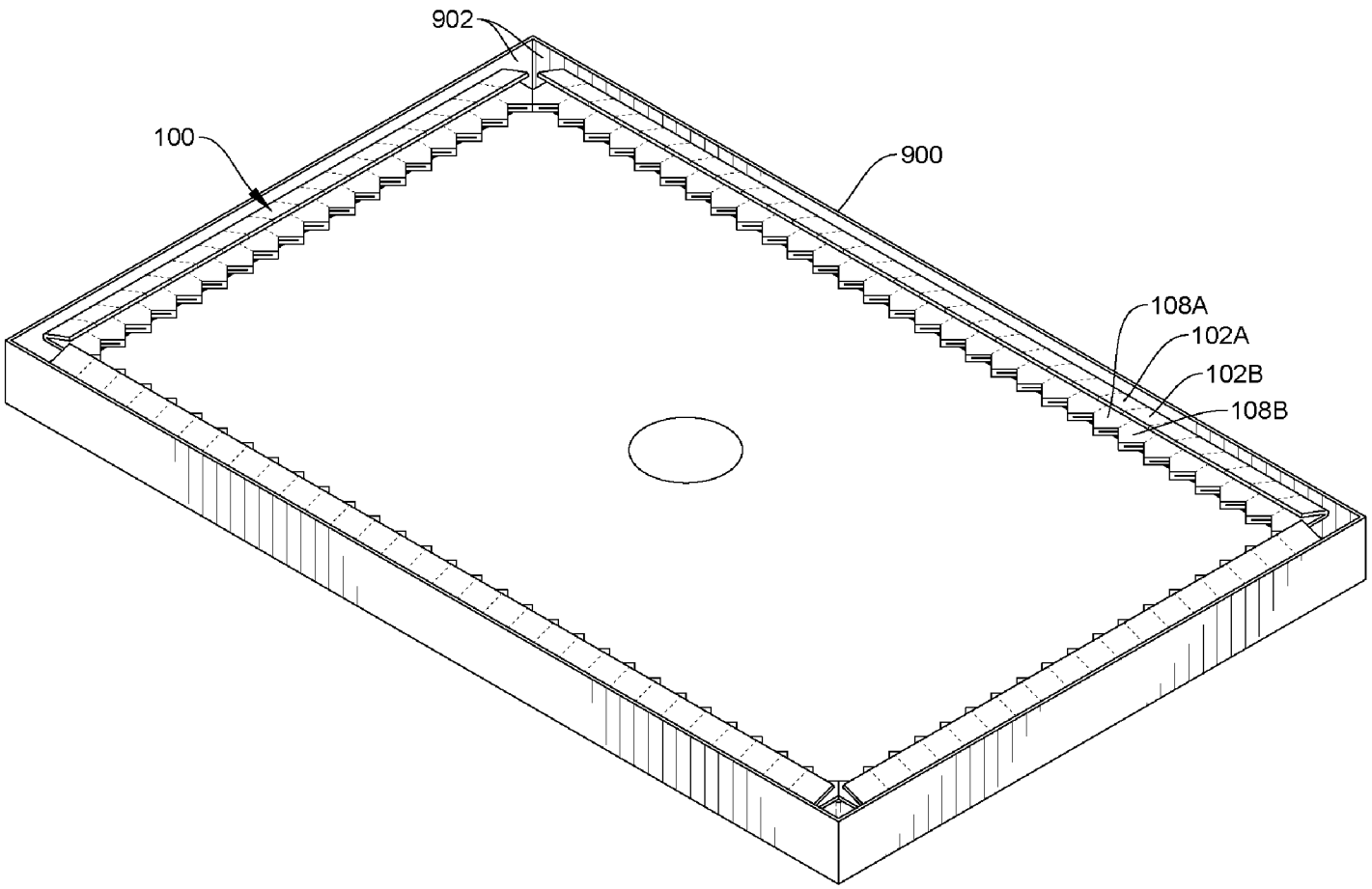
Figure 10:
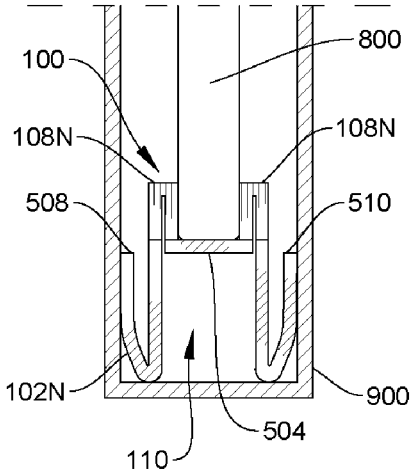
Figure 11:
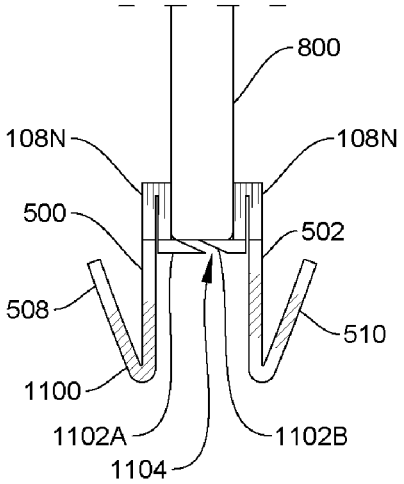
Figure 12:
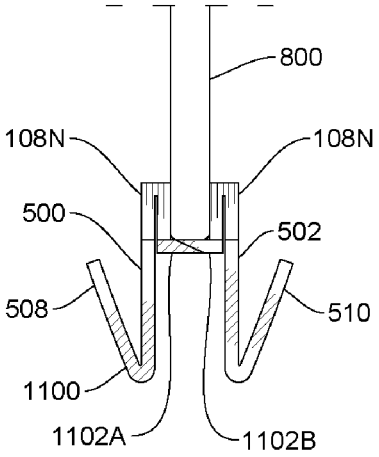

Having thus described the presently disclosed subject matter in general terms, reference will now be made to the accompanying Drawings, which are not necessarily drawn to scale, and wherein:

FIG. 1 is a perspective view of packaging material having segments and connectors for releasably detaching neighboring connectors in accordance with embodiments of the present disclosure;

FIG. 2 is a top view of the packaging material shown in FIG. 1;

FIG. 3 is a bottom view of the packaging material shown in FIGS. 1 and 2;

FIG. 4 is a side view of the packaging material shown in FIGS. 1-3;

FIG. 5 is a front view of the packaging material shown in FIGS. 1-4;

FIGS. 6 and 7 are side views of the packaging material at different steps for putting the packaging material in the packaging configuration in accordance with embodiments of the present disclosure;

FIG. 8 is a perspective view showing the packaging material in a packaging configuration for holding a laptop computer in accordance with embodiments of the present disclosure;

FIG. 9 is a perspective view of the packaging material with computer placed inside a box in accordance with embodiments of the present disclosure;

FIG. 10 is a cross-sectional side view of a portion of the box, packaging material, and computer shown in FIG. 9; and FIGS. 11 and 12 illustrate front views depicting different configurations of another example segment of packaging material in accordance with embodiments of the present disclosure.

SUMMARY

The presently disclosed subject matter relates to packaging materials having segments and connectors for releasably detaching portions of neighboring connectors. According to an aspect, packaging material includes segments positioned end-to-end with respect to each other. The packaging material also includes connectors that each include a first portion and a second portion for attaching respective neighboring segments together. Each first portion can pivotally connect its respective neighboring segments together. Each second portion is configured to separate for releasing its attachment of the neighboring segments. Further, the packaging material includes protrusions that are each attached to a respective segment. The protrusions are configured to at least partially abut each other when neighboring segments are pivoted with respect to each other to a corner packaging position.

DETAILED DESCRIPTION

The following detailed description is made with reference to the figures. Exemplary embodiments are described to illustrate the disclosure, not to limit its scope, which is defined by the claims. Those of ordinary skill in the art will recognize a number of equivalent variations in the description that follows.

Articles "a" and "an" are used herein to refer to one or to more than one (i.e. at least one) of the grammatical object of the article. By way of example, "an element" means at least one element and can include more than one element.

"About" is used to provide flexibility to a numerical endpoint by providing that a given value may be "slightly above" or "slightly below" the endpoint without affecting the desired result.

The use herein of the terms "including," "comprising," or "having," and variations thereof is meant to encompass the elements listed thereafter and equivalents thereof as well as additional elements. Embodiments recited as "including," "comprising," or "having" certain elements are also contemplated as "consisting essentially of" and "consisting" of those certain elements.

Recitation of ranges of values herein are merely intended to serve as a shorthand method of referring individually to each separate value falling within the range, unless otherwise indicated herein, and each separate value is incorporated into the specification as if it were individually recited herein. For example, if a range is stated as between 1%-50%, it is intended that values such as between 2%-40%, 10%-

30%, or 1%-3%, etc. are expressly enumerated in this specification. These are only examples of what is specifically intended, and all possible combinations of numerical values between and including the lowest value and the highest value enumerated are to be considered to be expressly stated in this disclosure.

Unless otherwise defined, all technical terms used herein have the same meaning as commonly understood by one of ordinary skill in the art to which this disclosure belongs.

Packaging materials disclosed herein can be sized and shaped to fit within interior spaces between an item being packaged and interior surfaces of a box in which the item is placed. As a result, these packaging materials can provide cushioning and support for fragile items such as electronic devices. Example electronic devices include, but are not limited to, computers, network equipment, and various other devices having electronic circuitry and components. The packaging material can be made of made of a single piece of paperboard, such as cardboard. In accordance with embodiment, packaging material disclosed herein can adapt to electronic equipment of various sizes and boxes sizes. Further, the packaging material can be manufactured as a continuous piece or strip. Also, continuous pieces or strips of the packaging material can be nested together for storage in a small space.

FIG. 1 illustrates a perspective view of packaging material, generally designated 100, having segments 102A-102N and connectors, generally designated 104A-104N for releasably detaching neighboring connectors in accordance with embodiments of the present disclosure. Referring to FIG. 1, the packaging material 100 is depicted in a storage configuration such that it extends along a direction indicated by arrow 106. Particularly, this this configuration, segments 102A-102N are positioned end-to-end with respect to one each other. The portion of the packaging material 100 shown in FIG. 1 includes segment 102A at one end, and extends to an opposing end at segment 102N. Any suitable number of segments may be part of the packaging material 100. As described in further detail herein, the packaging material 100 or a detached portion may be changed to a packaging configuration for use in packaging an item within a box in accordance with embodiments of the present disclosure.

With continuing reference to FIG. 1, the packaging material 100 includes multiple pairs of protrusions 108A-108N that extend generally in an upward direction indicated by arrow 110. In this example, the protrusion pairs 108A-108 extend generally in a direction that is perpendicular to the direction 106 that the segments 102A-102N extend, but may alternatively extend in another direction. The protrusion pairs 108A-108N may also extend in different directions from others. Further, the protrusion pairs 108A-108N are generally triangular in shape, but they may alternatively be any other suitable shape and size. Each protrusion pair 108A-108N is connected to a respective segment 102A-102N. In this example, each segment 102A-102N has a corresponding protrusion pair 108A-108N, but it is noted that in some examples a segment may not have a corresponding protrusion or the segment may be connected to any suitable number of protrusions.

A lower portion of the packaging material 100 forms a substantially U-shaped trench, generally designated 110, that extends the length of the packaging material 100. In the storage configuration, this shape permits storage nesting of the packaging material 100 with another piece of similar packaging material in the storage configuration. For example, the protrusions of one strip of packaging material may fit into the U-shaped trench of another packaging material 100 to store in a stack. Multiple packaging materials can be stacked in this way.

FIG. 2 illustrates a top view of the packaging material 100 shown in FIG. 1. Referring to FIG. 2, it can be seen that the pairs of protrusions 108A-108N form two lines that extend along the direction indicated by arrow 106. In addition, an upper, U-shaped trench, generally designated 200, is formed by the protrusion pairs 108A-108N and a top surface 202 of the segments 102A-102N. The trench 200 also extends along the direction indicated by arrow 106. As will be described in further detail herein, the trench 200 can be shaped to fit to a part of an item (e.g., an edge and corner of a computer) in the storage configuration.

FIG. 3 illustrates a bottom view of the packaging material 100 shown in FIGS. 1 and 2. Referring to FIG. 3, it can be seen that the lower trench 110 extends along the direction indicated by arrow 106.

FIG. 4 illustrates a side view of the packaging material 100 shown in FIGS. 1-3. Referring to FIG. 4, each segment 102A-102N is attached to a neighboring segment by a connector (one of connectors 104A-104N). It is noted that, in this example, segment 102N is an end segment so it is only connected to one neighboring segment. By way of example in this figure, a segment 104T is connected to its neighboring segments 104S and 104U via connectors 102S and 102T.

Connectors 102S and 102T each include portions 400 and 402 that form a perforation 404, which is a series of small holes or punctures in the paperboard for facilitating tearing. In this example, the perforations 404 extend along a substantially straight line from a lower side 406 of the packaging material 100 to an upper portion 408 of the packaging material 100. The portions 400 and 402 are attached together via their respective perforation 404 such that that can be detached from each other to release those attached portions of neighboring segments from each other. Further, it is noted that neighboring segments can also be attached together via non-perforated portions, an example of which is depicted in FIG. 3. Referring again to FIG. 3, it can be seen that a lower portion 300 of the trench 110 does not include perforations, and therefore it is continuous strip of material for holding together the segments.

As described in more detail herein, this construction of the perforations 404 and continuous strip of material permit someone forming the packaging material 100 into a packaging configuration to form corners or other shapes by partially detaching neighboring segments at their perforation while leaving other segments attached together. As an example, a corner can be formed at two neighboring segments 104S and 104T by detaching them from each other at their perforation 400 and then folding them at a portion (generally indicated by oval 302 in FIG. 3) where they can pivot with respect to each other. Thus, the portion generally indicated by oval 302 includes an axis of rotation where the neighboring segments 104S and 104T are connected.

Now turning to FIG. 5, this figure illustrates a front view of the packaging material 100 shown in FIGS. 1-4. Referring to FIG. 5, general shape of the strip of material can be seen. This view specifically shows the front shape of segment 102N. The segment 102N (and the other segments) include a pair of substantially flat components 500 and 502, which are spaced apart for forming the trench 110 therebetween. In this example, the components 500 and 502 are oriented substantially parallel with each other. The components 500 and 502 are also substantially rectangular in shape, but it should be understood that they can be any other suitable shape and size. Further, the components 500 and 502 are attached together via a segment portion 504. This segment portion 504 forms a part of the trench 110 together with components 500 and 502.

It is noted that, in this example, components 500 and 502 are connected together by segment portion 504 via protrusions 108N. As can be seen in FIG. 5, segment 102N is formed of a continuous piece of material that extends between components 500 and 502 via protrusions 108N and segment portion 504. As shown in the example of FIG. 5, protrusions 108N are each formed by their respective portions 506A and 506B that are folded over to be substantially parallel to and adjacent each other.

With continuing reference to FIG. 5, components 500 and 502 each include flexible components 508 and 510. The flexible components 508 and 510 generally extend outward from the length of the packaging material 100. Particularly, the flexible components 508 and 510 generally extend in opposing directions from one another and outward from the direction indicated by arrow 106 in FIG. 1. As described in further detail herein, the flexible components 508 and 510 can be used to form the packaging material 100 to an interior of a box or other packaging material for holding an item held by the packaging material 100 in place and separate from the sides of the box.

FIGS. 6 and 7 illustrate side views of the packaging material 100 at different steps for putting the packaging material in the packaging configuration in accordance with embodiments of the present disclosure. Initially referring to FIG. 6, this figure shows an initial step for forming a corner at the two neighboring segments 104S and 104T. At this initial step, the perforation attaching segments 104S and 104T has been broken to thereby release that those attached portions of the segments 104S and 104T. As a result, segments 104S and 104T can pivot about an axis 600 with respect to each other. The pivot point is at the lower portion 300 (shown in FIG. 3) where the segments are connected together but it is non-perforated. As shown in FIG. 6, segment 104S and its other attached segments are raised and pivoted at axis 600. By further pivoting segment 104S and its other attached segments, the protrusions 108S and 108T of segments 104S and 104T, respectively, can engage by abutting together (or at least partially abut together) to form a corner packaging position as shown in FIG. 7. In another example alternative to abutting each other, the protrusions 108S and 108T of segments 104S and 104T, respectively, can interlock or otherwise engage with one another for holding together. An interior part (generally designated 700) of the formed corner can receive and hold a corner or other part of an item, such as a computer, as described in further detail herein.

FIG. 8 illustrates a perspective view showing the packaging material 100 in a packaging configuration for holding a laptop computer 800 in accordance with embodiments of the present disclosure. Referring to FIG. 8, edges of the laptop computer 800 fit within the trench formed between the protrusions (i.e., 108A, 108B, etc.) of the packaging material 100. As described herein, perforations are detached at appropriate lengths of the packaging material 100 and corners formed to fit the packaging material 100 to the laptop computer 800 as shown. After the computer 800 and packaging material 100 are assembled as shown in FIG. 8, the assembly can be put inside a box for storage or transport. The outside of the packaging material 100 can fit to the box or other packaging material in the box's interior for protecting the computer 800.

FIG. 9 illustrates a perspective view of the packaging material 100 with computer 800 placed inside a box 900 in accordance with embodiments of the present disclosure. Referring to FIG. 9, it can be seen that the outside portions of the packaging material 100 conform to interior surfaces 902 of the box 900.

FIG. 10 illustrates a cross-sectional side view of a portion of the box 900, packaging material 100, and computer 900 shown in FIG. 9. Referring to FIG. 10, this portion shows segment 102N with its respective protrusions 108N and segment portion 504 holding an edge of the computer 800. Also, it is shown that flexible components 508 and 510 are deflected inward due to their positioning within the box 900. The inside surfaces of the box 900 push the flexible components 508 and 510 inward. As a result, they securely hold the computer 800 away from the sides of the box 900 in order to avoid damage in the case of the box being dropped, hit by an object, or punctured by an object.

FIGS. 11 and 12 illustrate front views depicting different configurations of another example segment 1100 of packaging material in accordance with embodiments of the present disclosure. Referring initially to FIG. 11, the segment 1100 is similar to segment 102N as shown in FIG. 5. They differ in that segment portion 504 of FIG. 5 is substituted with two portions 1102A and 1102B, which are not attached to each other. Rather, portions 1102A and 1102B can move adjacent one another to expand the gap between protrusions 108N. In this way, computers or other items of differing thicknesses can be accommodated. FIG. 11 shows a computer 800 with a wider thickness than the computer 800 shown in FIG. 12. In FIG. 11, a gap 1104 is shown between portions 1102A and 1102B due to portions 1102A and 1102B being spaced apart. In FIG. 12, portions 1102A and 1102B overlap in order to close the spacing between protrusions 108N to accommodate a narrower computer 800.

While the embodiments have been described in connection with the various embodiments of the various figures, it is to be understood that other similar embodiments may be used, or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed is:

1. Packaging material comprising:

a plurality of segments positioned end-to-end with respect to each other;

a plurality of connectors that each include a first portion and a second portion for attaching respective neighboring segments together, wherein each first portion pivotally connects its respective neighboring segments together, and wherein each second portion is configured to separate for releasing its attachment of the neighboring segments; and a plurality of protrusions that are each attached to a respective segment, wherein the protrusions are configured to at least partially engage each other when neighboring segments are pivoted with respect to each other to a corner packaging position.

2. The packaging material of claim 1, wherein each segment comprises a pair of substantially flat components that are spaced apart.

3. The packaging material of claim 2, wherein the flat components are oriented substantially parallel with each other.

4. The packaging material of claim 2, wherein the flat components are attached together via the first portion of their respective connector.

5. The packaging material of claim 2, wherein the flat components are each substantially rectangular in shape.

6. The packaging material of claim 1, wherein the first portion is made of a flexible material.

7. The packaging material of claim 1, wherein the segments extend substantially along a first direction, and wherein the protrusions extend in a second direction that is substantially perpendicular to the first direction.

8. The packaging material of claim 7, wherein the plurality of segments includes a first set of segments and a second set of segments, wherein the first set of segments and the second set of segments are pivotal with respect to each other via the first portion that attaches neighboring segments of the first set of segments and the second set of segments, and wherein the second portion between the first set of segments and the second set of segments is detached.

9. The packaging material of claim 8, wherein in the corner packaging position, the first set of segments and the second set of segments are aligned substantially perpendicular with respect to each other.

10. The packaging material of claim 1, wherein the segments extend substantially along a first direction, and wherein the segments each include at least one flexible component that extends outward from the first direction.

11. The packaging material of claim 1, wherein the segments extend substantially along a first direction, and wherein the segments each include a pair of flexible components that extend in substantially opposing directions and outward from the first direction.

12. The packaging material of claim 1, wherein the plurality of protrusions include a pair of protrusions that are oriented substantially parallel with each other.

13. The packaging material of claim 12, wherein the pair of protrusions and its respective segment form a substantially U shape for receiving and holding a portion of an electronic device.

14. The packaging material of claim 1, wherein the segments, connectors, and protrusions are made of a single piece of paperboard.

15. The packaging material of claim 1, wherein the first portion comprises at least two detached portions that are moveable with respect to each other.

16. The packaging material of claim 1, wherein the protrusions are configured to at least partially abut and/or interlock each other when neighboring segments are pivoted with respect to each other to a corner packaging position.

17. Packaging material comprising:

a plurality of segments positioned end-to-end with respect to each other, wherein the segments extend substantially along a first direction, wherein the segment each include a pair of flexible components that extend in substantially opposing directions and outward from the first direction;

a plurality of connectors that each include a first portion and a second portion for attaching respective neighboring segments together, wherein each first portion pivotally connects its respective neighboring segments together, and wherein each second portion is configured to separate for releasing its attachment of the neighboring segments; and a plurality of protrusions that are each attached to a respective segment, wherein the protrusions are configured to at least partially engage each other when neighboring segments are pivoted with respect to each other to a corner packaging position, and wherein the protrusions extend in a second direction that is substantially perpendicular to the first direction.

18. The packaging material of claim 17, wherein the plurality of protrusions includes a pair of protrusions that are oriented substantially parallel with each other.

19. The packaging material of claim 18, wherein the pair of protrusions and its respective segment form a substantially U shape for receiving and holding a portion of an electronic device.

20. The packaging material of claim 17, wherein the first portion is made of flexible material.

* * * * *